US009427369B2

(12) United States Patent
Cox et al.

(10) Patent No.: US 9,427,369 B2
(45) Date of Patent: Aug. 30, 2016

(54) FOLDABLE CASKET WITH CORNER SUPPORTS

(71) Applicant: Vandor Corporation, Richmond, IN (US)

(72) Inventors: Gary L. Cox, Richmond, IN (US); Gerald H. Davis, Fountain City, IN (US); Chad L. Eversole, Richmond, IN (US); Jerry D. Rone, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 14/592,470

(22) Filed: Jan. 8, 2015

(65) Prior Publication Data

US 2016/0199244 A1 Jul. 14, 2016

(51) Int. Cl.

| | |
|---|---|
| ***A61G 17/02*** | (2006.01) |
| ***A61G 17/007*** | (2006.01) |
| ***A61G 17/04*** | (2006.01) |
| *A61G 17/00* | (2006.01) |

(52) U.S. Cl.

CPC ..... *A61G 17/02* (2013.01); *A61G 17/0073* (2013.01); *A61G 17/04* (2013.01); *A61G 2017/004* (2013.01)

(58) Field of Classification Search

CPC ..... A61G 17/02; A61G 17/0073; A61G 2017/004; A61G 17/04; B65D 5/002; B65D 5/0025; B65D 5/64

USPC ..... 27/4, 14; 229/125.01, 191, 918

See application file for complete search history.

(56) References Cited

U.S. PATENT DOCUMENTS

| | | | | |
|---|---|---|---|---|
| 3,162,351 | A * | 12/1964 | Rudofski | B65D 5/001 206/586 |
| 3,648,920 | A * | 3/1972 | Stump | B65D 5/5033 138/177 |
| 5,535,941 | A * | 7/1996 | Garza | B65D 5/6644 229/191 |
| 5,661,879 | A * | 9/1997 | Kelly | A61G 17/00 229/167 |
| 6,158,653 | A * | 12/2000 | Kanter | B65D 5/001 229/120.11 |
| 6,564,993 | B1 * | 5/2003 | Wassink | B65D 5/0055 220/642 |
| 6,874,679 | B2 * | 4/2005 | Tibbles | B65D 5/001 229/120.11 |
| 7,249,403 | B2 * | 7/2007 | Davis | A61G 17/00 16/424 |
| 8,347,467 | B2 | 1/2013 | Davis | |
| 2002/0113117 | A1 * | 8/2002 | Bradish | B65D 5/445 229/199 |
| 2003/0167611 | A1 * | 9/2003 | Belanger | A61G 17/0073 27/4 |
| 2012/0073098 | A1 * | 3/2012 | Centenari | A61G 17/0073 27/4 |

* cited by examiner

*Primary Examiner* — William Miller

(74) *Attorney, Agent, or Firm* — Maginot, Moore & Beck LLP

(57) ABSTRACT

A casket includes a container configured to receive a deceased, the container including a bottom and sides defining at least a part of a casket interior. The casket further includes a lid disposed on the container to cover the casket interior. The lid is formed from a corrugated paperboard blank folded into a lid structure. The lid structure includes a top panel, at least two side panels and at least one end panel, and a plurality of supports extending to a height of the side panels. Each of the corner supports includes at least a first panel extending diagonally from a first location proximate one of the side panels to a second location proximate the at least one end panel. The first panel has a first length corresponding to the height of the side panels.

20 Claims, 6 Drawing Sheets

FOLDABLE CASKET WITH CORNER SUPPORTS

FIELD OF THE INVENTION

The present invention relates generally to caskets, and more particularly, to lightweight caskets.

BACKGROUND OF THE INVENTION

Caskets and cremation containers are constructed from a plurality of materials, including wood, metal, and paper materials, as well as combinations of the foregoing. These caskets and cremation containers vary substantially in price. While wood and metal-based caskets can be expensive, paper-based cremation containers can provide a viable low cost option when cremation is contemplated. In fact, extremely low costs may be achieved by employing a corrugated paper cremation container, which costs a fraction of the cost of hardwood or metal caskets. Even if cost is not a major consideration, corrugated paper caskets are a popular choice for cremation, in part because they are completely consumed during the cremation process.

Many corrugated paper caskets can have ornamentation and other design elements that approximate decorative wood or steel caskets. Many people find such paper caskets to be suitable for presentation at a viewing and/or funerary service. These ornately designed paper caskets represent a cost savings over hardwood caskets, and are particularly advantageous in cases in which the casket is to be consumed during the cremation process.

While ornately designed paper caskets are less expensive than hardwood caskets, they still represent a significant cost that may not be practical in some cases. In such cases, a more inexpensive option is a simple rectangular corrugated paper container and associated simple rectangular lid that fits over the container in a manner similar to that of a common shoebox. The deceased fits within the container and then the rectangular lid is fitted over the container to close off the casket.

The need for such inexpensive caskets arises in situations of financial need, and also in disaster areas where many deceased are located in a relatively small area. The paper container has significant advantages over traditional caskets in this environment including the ability to transport significant numbers of the lightweight paper casket and the disposability of such caskets.

While cardboard cremation caskets are typically considered to be an economical approach the storage of the deceased, a significant cost nevertheless arises as a result of shipping and storage costs. Even though the caskets are fairly light, they are more or less as bulky as traditional wood and metal caskets.

One solution to the costs associated with storage and shipment of caskets is the implementation of paperboard caskets that can be shipped as flat paperboard blanks, or as partially constructed caskets, which can be further constructed as needed at the funeral or cremation establishment. For example, U.S. Pat. No. 8,347,467 shows a lightweight, inexpensive casket that may in large part assembled at the funeral establishment, or other retail establishment where the casket may be sold. The foldable casket of U.S. Pat. No. 8,347,467 is relatively easy to assemble, is low cost, and occupies a reduced footprint during shipping and storage. For example, in the casket shown in FIG. 6 of U.S. Pat. No. 8,347,467, the base, which requires more complex assembly, may be assembled prior to shipment, such as at the factory.

The lid, which is bulkier and lighter, can be shipped flat and assembled at the funerary establishment or other retail or wholesale establishment.

Nevertheless, one drawback of lightweight foldable caskets is that in many cases, they cannot be stacked (in the assembled state) without damaging the lids. In particular, it is sometimes desirable for the casket retail establishment to assemble several caskets to be ready for immediate use. It is often convenient to store multiple assembled paperboard caskets by stacking the caskets. However, the lightweight lids of the caskets, when assembled, often do not have sufficient strength to support several stacked caskets. When such caskets are stacked, the lids can bend or crush under the weight.

Accordingly, there is a need for a lightweight foldable casket that can be stacked after assembly without damaging the lid of the casket.

BRIEF SUMMARY OF THE INVENTION

The inventions described herein have several aspects, each of which individually addresses on or more of the problems of the prior art discussed above, and/or other problems or shortcomings not specifically mentioned, but which will become readily apparent to those of ordinary skill in the art by reference to the following detailed description and accompanying drawings.

In a first embodiment, a casket includes a container configured to receive a deceased, the container including a bottom and sides defining at least a part of a casket interior. The casket further includes a lid disposed on the container to cover the casket interior. The lid is formed from a corrugated paperboard blank folded into a lid structure. The lid structure includes a top panel, at least two side panels and at least one end panel, and a plurality of supports extending to a height of the side panels. Each of the corner supports includes at least a first panel extending diagonally from a first location proximate one of the side panels to a second location proximate the at least one end panel. The first panel has a first length corresponding to the height of the side panels.

The support structures strengthen the lid sufficient to allow items, for example, other caskets, to be stacked atop the assembled lid. The lid structure in at least some embodiments may be assembled at a retail establishment due to the ease of assembly The above described features and advantages, as well as others, will become more readily apparent to those of ordinary skill in the art by reference to the following detailed description and accompanying drawings.

DETAILED DESCRIPTION

Figure 1:
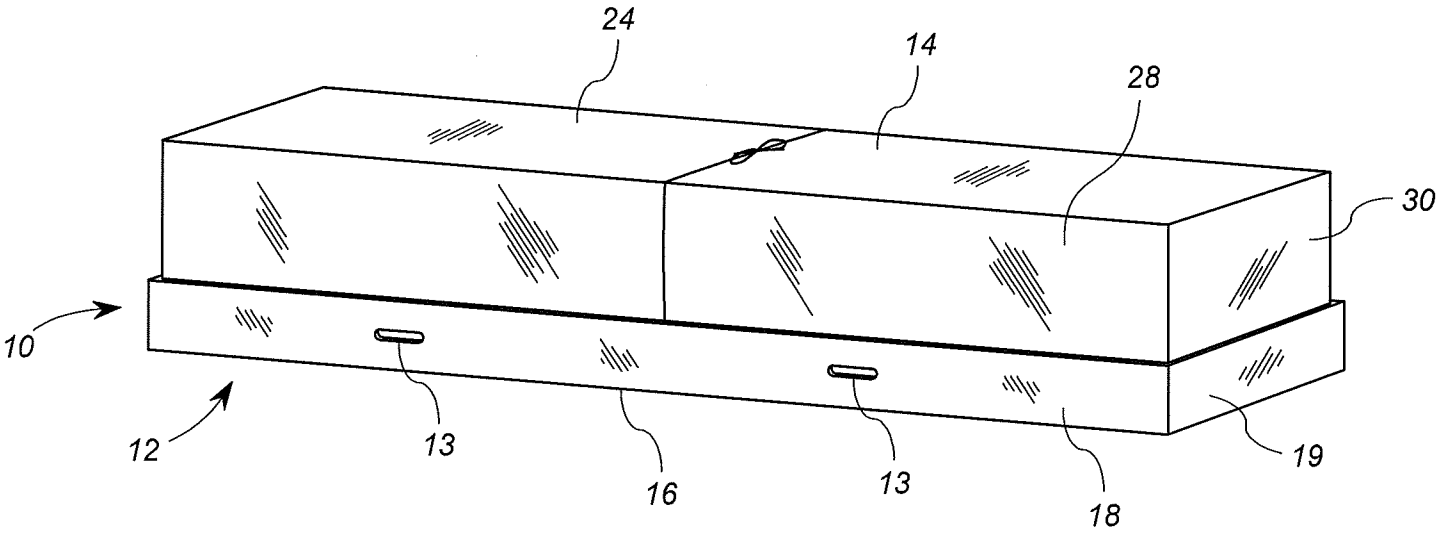
FIG. 1 shows a perspective view of an exemplary casket according to a first embodiment of the present invention.

For the purposes of promoting an understanding of the principles of the invention, reference will now be made to the embodiments illustrated in the drawings and described in the following written description. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

FIG. 1 shows an embodiment of a casket 10 that includes strengthening features and a convenient assembly. The exemplary casket arrangement 10 according to the invention includes a casket body or container 12 and a one piece lid 14. The container 12 is preferably in the form of an open-top box formed of corrugated paper. To this end, the container 12 includes a bottom panel 16, side panels 18, end panels 19, and defines at least part of a casket interior, not visible in FIG. 1, but which disposed in the area generally between the side panels 18 and the end panels 19. The container also includes handle holes 13. The container 12 may suitably have the same structure as the casket body of FIG. 6 of U.S. Pat. No. 8,347,467, the disclosure of which is incorporated herein by reference. However, it will be appreciated that other casket containers designs may be used in other embodiments.

Figure 2:
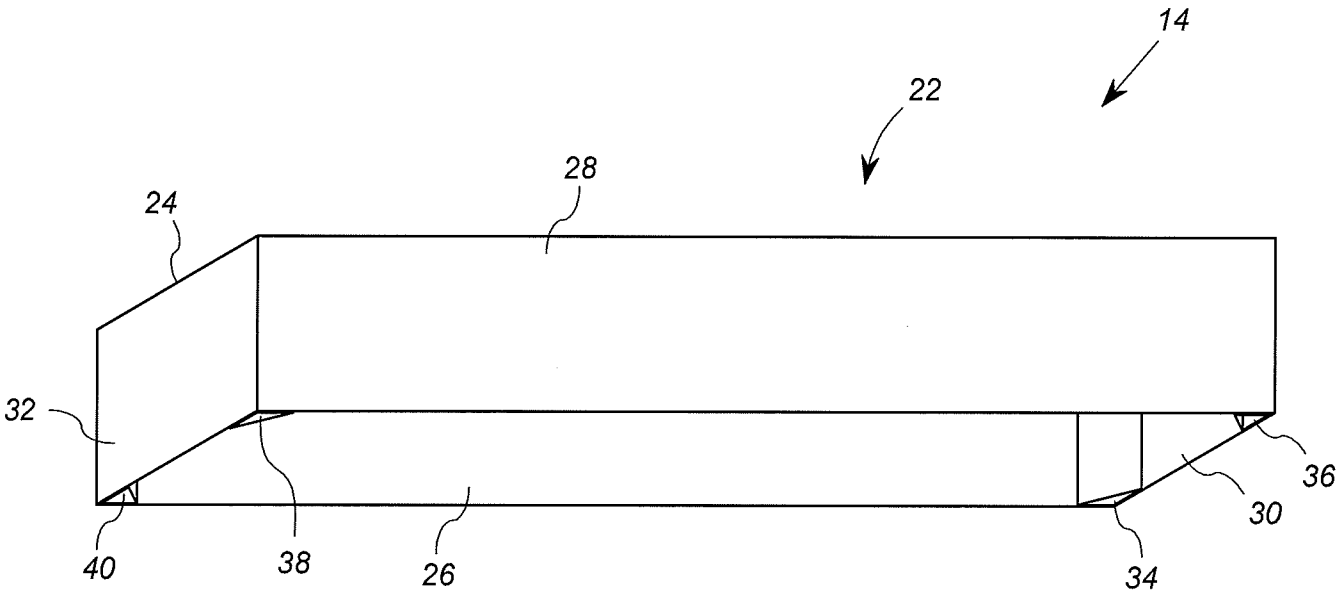
FIG. 2 shows a perspective view of an exemplary lid structure according to at least one embodiment of the present invention.

The lid 14 is disposed on the container 12 to cover the casket interior. The lid 14 is formed from a corrugated paperboard blank 100 (see FIG. 4) folded into a lid structure 22. FIG. 2 shows a perspective view of the lid 14, apart from the container 12 to reveal the bottom structure. With simultaneous reference to FIGS. 1 and 2, the lid structure 22 includes a top panel 24, a first side panel 26, a second side panel 28, a first end panel 30, a second end panel 32, and four corner supports 34, 36, 38 and 40. The four corner supports 34, 36, 38 and 40 provide the structural strength to the lid 14 to withstand stacking weight of multiple similar caskets. To this end, the corner supports 34, 36, 38 and 40 have the same height as the side panels 26, 28, or in other words extend from the top panel 24 to the lower edge of the side panels 26, 28.

Figure 3:
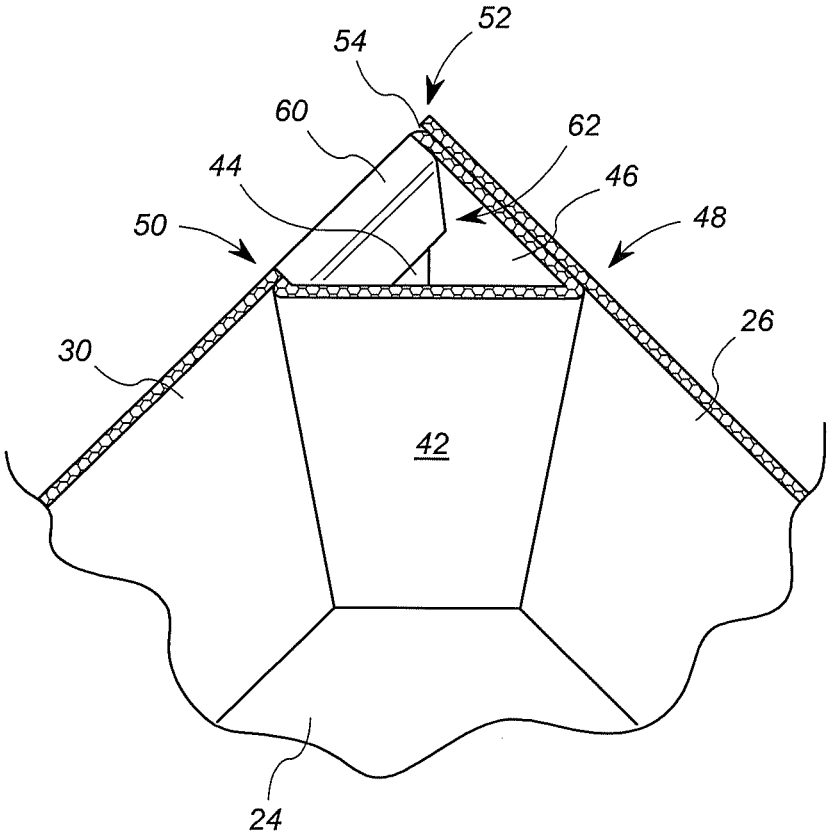
FIG. 3 shows a fragmentary perspective view of a portion of the lid structure of FIG. 2.

FIG. 3 shows a fragmentary perspective view that illustrates the first corner support 34 in further detail. The corner support includes a first panel 42, a second panel 44, and a third panel 46 that are integrally formed with each other, and formed from folding paper board, as will be discussed below in connection with FIGS. 4-5*g*. The first panel 42 extends diagonally from a first location 48 proximate the first side panel 26 to a second location 50 proximate the end panel 30. The first panel 42 has a first length corresponding to the height of the side panel 26 as well as the end panel 30. However, it will be appreciated that in alternative embodiments, the first panel 42 may have a length that it substantially the same as the longer of either the side panel 26 or the end panel 30.

The second panel 44 extends from the first panel 42 at the second location 50 to a third location 52 that is proximate an intersection 54 of the first side panel 26 and the first end panel 30. The second panel 44 extends from and is foldably connected to the first side panel 26. It will be appreciated that in an alternative embodiment, the second panel 44 is foldably connected to the first end panel 30 and extends from the first panel 42 at the first location 48 to the third location 52. In any event, the second panel 44 has the same height/length as that of the first panel 42.

The third panel 46 extends from the first location 48 to the third location 52. To this end, the third panel 46 extends from and is foldably coupled to the first panel 42. Thus, in this embodiment, the third panel 46 is coupled directly to the first panel 42, and the second panel 44 is coupled directly to the first panel 42. The third panel 46 has the same height/length as that of the first panel 42. The third panel 46 also includes one or more tabs 56 (not shown in FIG. 3) extending from an edge of the third panel. As will be discussed below in connection with FIGS. 5*a*-5*g*, the tab 56 is received into a corresponding slot 58 located at the intersection 54 of the first side panel 26 and the first end panel 30.

As shown in FIG. 3, the first end panel 30 further includes a first end tab 60 extending from the edge of the first end panel 30. In the folded lid structure 22, the first end tab 60 is disposed in a fourth location 62 defined between the first panel 42 and the first end panel 30 and/or and the first side panel 26. In this embodiment, the first end tab 60 is of sufficient width that it is trap fit by first panel 42 and the first side panel 26 against the first end panel 30. The first end tab 60 thus operates in part hold the first end panel 30 in position. In other embodiments, fasteners and/or adhesive may be used. However, to facilitate assembly at funeral homes and other retail establishments, the trap fit of the embodiment described herein is especially advantageous because it eliminates the need for adhesives or coupling mechanisms.

Referring again to FIGS. 1 and 2, it will be appreciated that the corner supports 36, 38 and 40 have substantially the same structure and configuration as that of the first corner support 34. Moreover, the other intersections of side panels 26, 28 and the end panels 30, 32 include slots for receiving tabs of corresponding third panels of the respective corner supports 36, 38 and 40.

The lid structure 22 shown in FIGS. 1-3 provides an easy to assemble lid 14 that may be shipped as a corrugated or kraft paper board blank. The lid structure 22, when assembled onto the container 12 (or other containers), can be stacked with other like structures without damage or failure.

Figure 4:
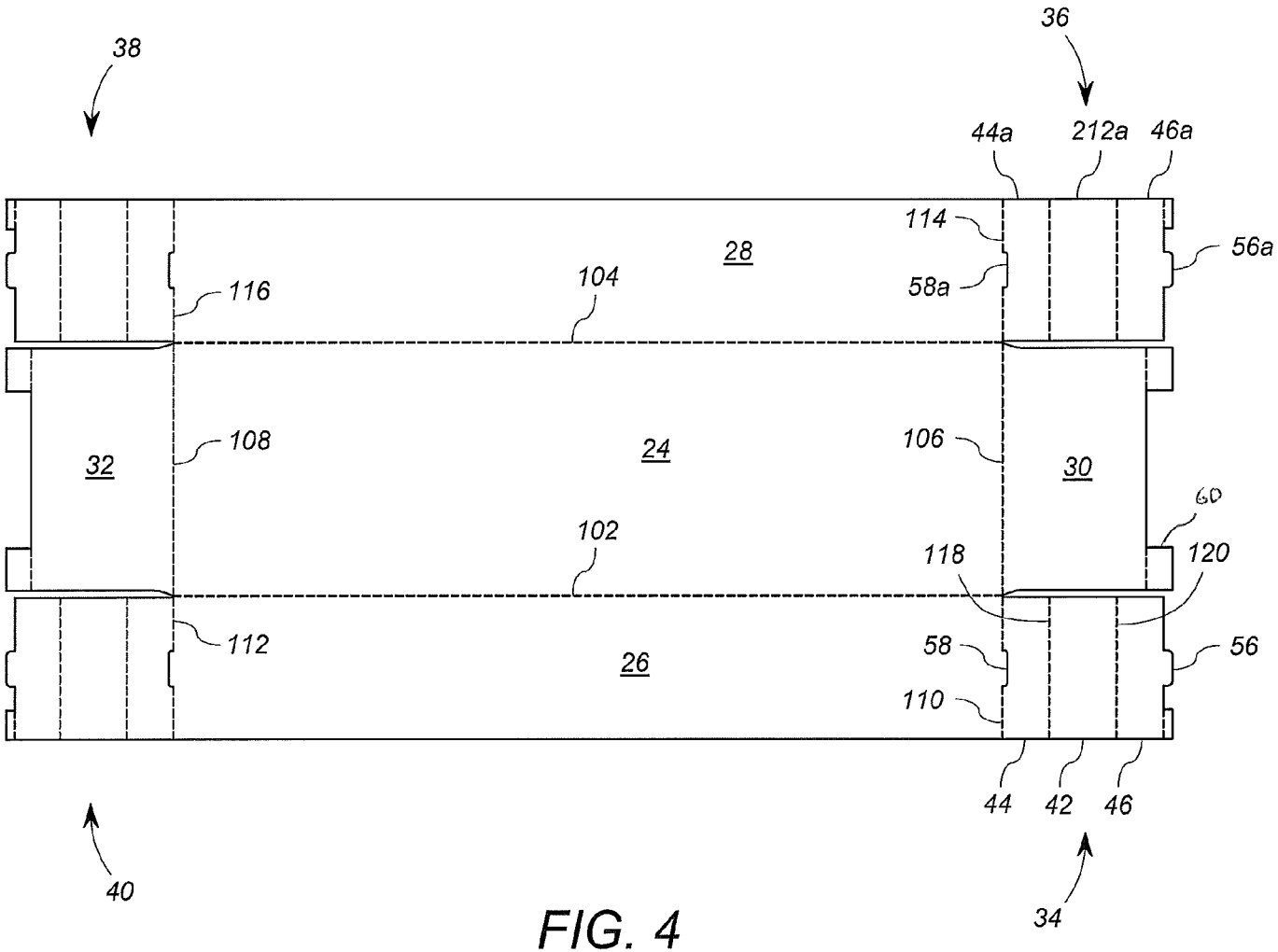
FIG. 4 shows an exemplary embodiment of a blank that may be folded into the lid structure of FIG. 2.

FIG. 4 shows a corrugated paperboard blank 100 from which the lid structure 22 is formed. The blank 100 includes all the elements and features of the lid structure 22 in unfolded form. Like reference numbers are used to identify similar structures on the blank 100 of FIG. 4 and the lid structure 22 of FIGS. 1-3.

As shown in FIG. 4, the side panels 26, 28 are connected to the top panel 24 via respective fold lines 102, 104. Similarly, the end panels 30, 32 are connected to the top panel 24 via respective fold lines 106, 108. The first corner support 34 is connected to one of the short edges of the first side panel 26 via a fold line 110. The fourth corner support 40 is connected to the opposite short edge of the first side panel 26 via a fold line 112. The second corner support 36 is connected to one of the short edges of the second side panel 28 via a fold line 114, and the third corner support 38 is connected to the opposite short edge of the first side panel 26 via a fold line 116.

Referring specifically to the first corner support 34, the fold line 110 connects the first side panel 26 to the second panel 44 of the first corner support 34. The slot 58 is disposed on or about, and preferably extends parallel to, the fold line 110. The opposite edge of the second panel 44 is coupled to the first panel 42 via a fold line 118. The opposite edge of the first panel 42 is coupled to the third panel 46 via a fold line 120.

As discussed further above, the second corner support 36 has substantially the same structure as the first corner support 34. Accordingly, the second corner support 36 also has a first panel 42*a*, second panel 44*a*, and third panel 46*a* coupled in the same way. The second corner support 36 also includes a tab 56*a* on the third panel 46*a* that is configured to be received by a corresponding slot 58*a* in the fold line 114. As discussed above in connection with FIGS. 1-3, the third corner support 38 an fourth corner support 40 have the same structure.

It will be appreciated that the blank 100 may suitably be die-cut from rectangular piece of paperboard or kraft paper. The fold lines 102, 104, 106, 108, 110, 112, 114, 116, 118 and 120 may suitably be slit scored.

Figure 5B:
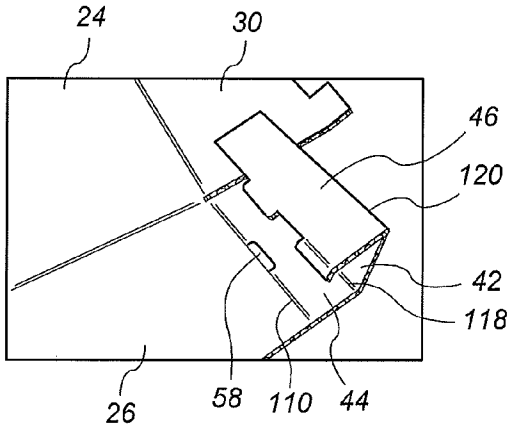
FIG. 5*b* shows the fragmentary perspective view of the blank of FIG. 5*a* wherein the blank has been partially assembled into the lid structure of FIG. 2.
Figure 5A:
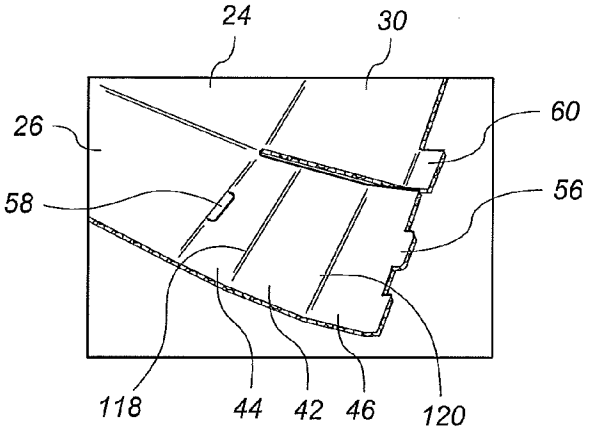
FIG. 5*a* shows a fragmentary perspective view of the blank of FIG. 4.
Figure 5D:
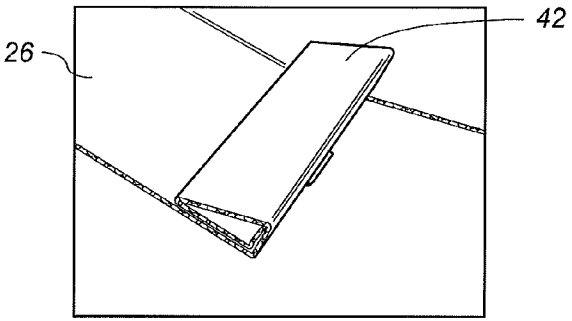
FIG. 5*d* shows the fragmentary perspective view of the blank of FIG. 5*a* wherein the corner support of the lid structure of FIG. 2 has been substantially completed.
Figure 5C:
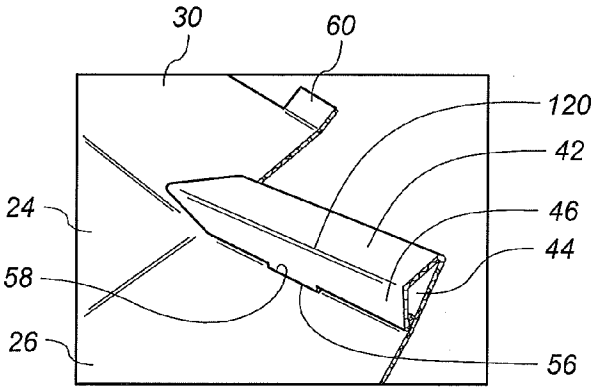
FIG. 5*c* shows the fragmentary perspective view of the blank of FIG. 5*a* wherein the blank has been further partially assembled into the lid structure of FIG. 2.
Figure 5F:
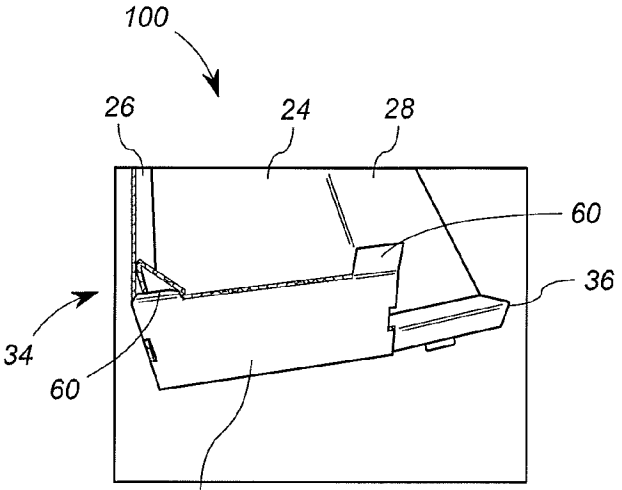
FIG. 5*f* shows the fragmentary perspective view of the blank of FIG. 5*e* wherein the lid structure is further assembled.
Figure 5E:
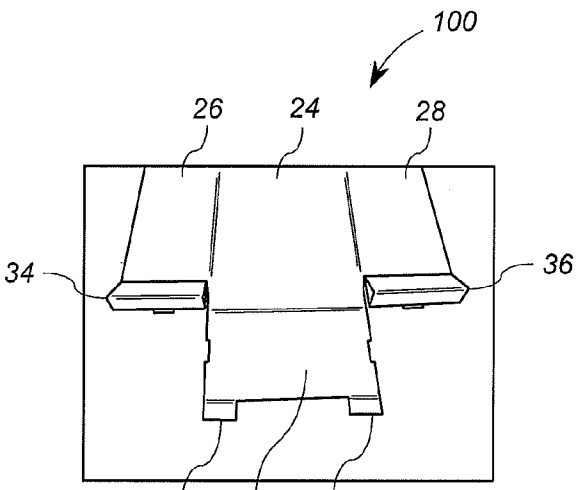
FIG. 5*e* shows a different fragmentary perspective view of the blank of FIG. 4 showing two corner supports substantially completed.
Figure 5G:
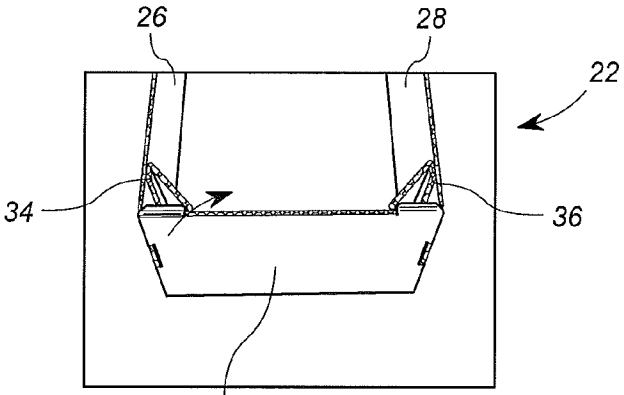
FIG. 5*g* shows the fragmentary perspective view of FIG. 5*e* wherein the lid structure is completed.

FIGS. 5*a*-5*g* show a series of fragmentary views of the blank 100 that illustrate the method of construction of the corner support 34 and the corresponding side panels 26, 28 and end panel 30. FIGS. 5*a*-5*d* show the panels 42, 44, and 46 of the first corner support 34 in different stages of folding/assembly. FIGS. 5*e*-5*g* show the assembly of one of the end panels 30 onto the side panels 26, 28.

Referring to FIG. 5*a*, FIG. 5*a* shows a fragmentary view of the blank 100 illustrating the panels 42, 44 and 46 in an unfolded state. In a first step, with the blank 100 lying flat on a surface, the third panel 46 is folded upward along fold line 120 with respect to the first panel 42, and the first panel 42 is folded in the same way along the fold line 118 with respect to the third panel 44, as shown in FIG. 5*b*. As shown in FIG. 5*c*, the panels 46 and 44 are further folded over onto themselves to form a triangular structure, and the tab 56 is inserted into the slot 58.

Thereafter, the triangular structure formed by the panels 42, 44, and 46 is further folded over such until the third panel 46 extends in a plane that is almost parallel to that of the side panel 26, as shown in FIG. 5*d*. The resulting structure in FIG. 5*d* is the substantially complete corner structure 34.

FIG. 5*e* shows a fragmentary perspective of the blank 100 with the first and second corner supports 34, 36 assembled, but the side panels 26, 28 and end panel 30 unassembled with respect to each other. To complete the assembly of the lid structure 22, the side panels 26, 28 are folded up to the vertical position, the first end panel 30 is folded up to the vertical position, and then the end tabs 60 are inserted into the interiors of the corner supports 34, 36. (See FIGS. 5*f*, 5*g*). The second end panel 32, not shown in FIGS. 5*f*, 5*g*, is constructed in an analogous way.

The method of construction illustrated in FIGS. 5*a* to 5*g* may readily be carried out at a retail establishment. As a consequence, the blank 100 of FIG. 4 may be shipped to a location, along with (or separate from) a more complex, assembled base, such as the container 12. Because in many cases, such as the embodiment of FIG. 1, the container 12 has a lower profile than the lid 14, shipping an assembled container 12 and an unassembled blank 100 can save significant space. In some embodiments, both the container 12 and the lid 14 may be shipped in unassembled state, and assembled at the retail location, thus further saving shipping costs and space.

The supports 34, 36, 38 and 40 provide an integral strengthening mechanism along the load bearing portion of the casket 10 that extends from the top of the lid 14 to the base or bottom of the container 12. The supports 34, 36, 38 and 40 thereby allow for the stacking of other caskets or objects on top of the lid 14, both on and off of the container 12. The strengthening can occur even if fewer than all four corner supports are employed, and/or if additional strengthening measures are employed. In the exemplary embodiment described herein, the diagonal first panel 42 of the support 34 provides a strengthening bracing, and the panels 44 and 46 reinforce the corner areas of the side panel 26 and end panel 30.

It will be appreciated that the above-described embodiments are merely illustrative, and that those of ordinary skill in the art may readily devise their own implementations and modifications that incorporate the principles of the present invention and fall within the spirit and scope thereof.

We claim:

1. A casket, comprising:

a container configured to receive a deceased, the container including a bottom and sides defining at least a part of a casket interior;

a lid disposed on the container to cover the casket interior, the lid formed from a corrugated paperboard blank folded into a lid structure, the lid structure including a top panel, at least two side panels and at least one end panel, and a plurality of corner supports extending to a height of the side panels and engaging the bottom of the container, each of the corner supports including at least a first panel extending diagonally from a first location proximate one of the side panels to a second location proximate the at least one end panel, the first panel having a first length corresponding to the height of the side panels.

2. The casket of claim 1, wherein the container is constructed at least in part from corrugated paperboard.

3. The casket of claim 1, wherein a first support of the plurality of corner supports further includes a second panel extending from the first panel to a third location proximate an intersection of a first side panel of the at least two side panels and a first end panel of the at least one end panel.

4. The casket of claim 3, wherein the second panel integrally extends from and is foldably connected to one of the first side panel or the first end panel.

5. The casket of claim 4, wherein the second panel has the first length.

6. The casket of claim 4, wherein the first support further includes a third panel extending from one of the first location and second location to the third location, the third panel extending from and is foldably coupled to one of the first panel and the second panel.

7. The casket of claim 6, wherein the third panel is coupled directly to the first panel, and the second panel is coupled directly to the first panel.

8. The casket of claim 6, wherein each of the second panel and the third panel has the first length.

9. The casket of claim 1, wherein the lid has a greater height than the container.

10. A casket, comprising:

a container configured to receive a deceased, the container including a bottom and sides defining at least a part of a casket interior;

a lid disposed on the container to cover the casket interior, the lid formed from a corrugated paperboard blank folded into a lid structure, the lid structure including a top panel, at least two side panels and at least one end panel, and a plurality of corner supports extending to a height of the side panels, each of the corner supports including at least a first panel extending diagonally from a first location proximate one of the side panels to a second location proximate the at least one end panel, the first panel having a first length corresponding to the height of the side panels, wherein, the container is constructed at least in part from corrugated paperboard;

a first support of the plurality of corner supports further includes a second panel extending from the first panel to a third location proximate an intersection of a first side panel of the at least two side panels and a first end panel of the at least one end panel;

the second panel integrally extends from and is foldably connected to one of the first side panel or the first end panel;

first support further includes a third panel extending from one of the first location and second location to the third location, the third panel extending from and is foldably coupled to one of the first panel and the second panel;

the third panel is coupled directly to the first panel, and the second panel is coupled directly to the first panel; and the third panel includes at least one tab extending from an edge thereof the at least one tab received in at least one corresponding slot located at the intersection of the first side panel and the first end panel.

11. The casket of claim 10, further comprising an end tab extending from an edge of the first end panel into a fourth location defined between the first panel and one of the first end panel and the first side panel.

12. A casket lid structure, comprising:

a lid configured to be disposed on a container to cover a casket interior, the lid formed from a corrugated paperboard blank folded into a lid structure, the lid structure including a top panel, at least two side panels and at least one end panel, and a plurality of corner supports extending to a height of the side panels and adapted to engage a bottom of the container, each of the corner supports including at least a first panel extending diagonally from a first location proximate one of the side panels to a second location proximate the at least one end panel, the first panel having a first length corresponding to the height of the side panels.

13. The casket lid structure of claim 12, wherein a first support of the plurality of corner supports further includes a second panel extending from the first panel to a third location proximate an intersection of a first side panel of the at least two side panels and a first end panel of the at least one end panel.

14. The casket lid structure of claim 13, wherein the second panel integrally extends from and is foldably connected to one of the first side panel or the first end panel.

15. The casket lid structure of claim 14, wherein the second panel has the first length.

16. The casket lid structure of claim 14, wherein the first support further includes a third panel extending from one of the first location and second location to the third location, the third panel extending from and is foldably coupled to one of the first panel and the second panel.

17. The casket lid structure of claim 16, wherein the third panel is coupled directly to the first panel, and the second panel is coupled directly to the first panel.

18. The casket lid structure of claim 17, wherein the third panel includes at least one tab extending from an edge thereof the at least one tab received in at least one corresponding slot located at the intersection of the first side panel and the first end panel.

19. The casket lid structure of claim 18, further comprising an end tab extending from an edge of the first end panel into a fourth location defined between the first panel and one of the first end panel and the first side panel.

20. The casket lid structure of claim 16, wherein each of the second panel and the third panel has the first length.

* * * * *